United States Patent [19]

Schommer et al.

[11] Patent Number: 4,590,855

[45] Date of Patent: May 27, 1986

[54] REVERSE ANGLE DOCTOR BLADE ASSEMBLY WITH STATIONARY END SEAL

[75] Inventors: David L. Schommer; Wayne LaValliere, both of Pulaski, Wis.

[73] Assignee: Printco Industries, Ltd., Pulaski, Wis.

[21] Appl. No.: 621,498

[22] Filed: Jun. 18, 1984

[51] Int. Cl.[4] ..... B41F 9/10; B41F 31/04; B41F 31/06

[52] U.S. Cl. ..... 101/157; 101/350

[58] Field of Search ..... 101/350, 363, 364, 366, 101/365, 148, 207–210, 157, 169; 118/259, 261

[56] References Cited

U.S. PATENT DOCUMENTS

| | | | |
|---|---|---|---|
| Re. 30,819 | 12/1981 | Schaeuble | 427/345 |
| 2,018,193 | 10/1935 | Smith | 101/366 |
| 2,018,959 | 10/1935 | Jordhoy | 101/363 |
| 2,151,968 | 3/1939 | Henderson | 101/157 |
| 2,151,969 | 3/1939 | Henderson | 101/366 X |
| 2,168,229 | 8/1939 | MacArthur | 101/211 X |
| 2,177,656 | 10/1939 | Kaddeland | 101/157 |
| 2,226,311 | 12/1940 | Klingler | 101/157 |
| 2,350,089 | 5/1944 | Behringer | 101/157 |
| 2,377,110 | 5/1945 | Smith | 101/157 |
| 2,495,017 | 1/1950 | Meyer | 101/157 |
| 2,717,550 | 9/1955 | Behringer | 101/157 |
| 2,922,364 | 1/1960 | Nitchie et al. | 101/364 |
| 2,931,297 | 4/1960 | Coudriet | 101/157 |
| 3,044,396 | 7/1962 | Aller | 101/157 |
| 3,046,885 | 7/1962 | Neal | 101/350 |
| 3,135,197 | 6/1964 | Dutro et al. | 101/364 |
| 3,333,535 | 8/1967 | Behringer | 101/157 |
| 3,695,221 | 10/1972 | Schaeuble | 118/203 |
| 3,766,856 | 10/1973 | Hardt | 101/169 X |
| 4,009,657 | 3/1977 | Bonanno et al. | 101/169 |
| 4,026,210 | 5/1977 | Merzagora | 101/350 |
| 4,181,076 | 1/1980 | Gattus | 101/350 |
| 4,222,328 | 9/1980 | Doyle | 101/366 X |
| 4,361,089 | 11/1982 | Wittkopf et al. | 101/366 X |
| 4,414,900 | 11/1983 | Kraus et al. | 101/363 |
| 4,461,211 | 7/1984 | Wesselman et al. | 101/169 |

OTHER PUBLICATIONS

Michael J. Larkin, A Review of Coaters for High/100% Solids Use, Mar. 1980, *Paper, Film & Foil Converter,* pp. 60–64.

*Primary Examiner*—J. Reed Fisher

*Attorney, Agent, or Firm*—Willian Brinks Olds Hofer Gilson & Lione Ltd.

[57] ABSTRACT

A reverse doctor blade assembly dispenses and applies a liquid such as ink or an adhesive to the surface of a rotating transfer roll. The assembly has a reservoir chamber which is sealed at its ends by resilient end seals which are pressed against corresponding seal support rings held in stationary, sliding relation at the ends of the rotating transfer roll. The reverse doctor blade assembly further includes opposing detachable brackets which support two spaced doctor blades in fixed relation to the reservoir chamber. The brackets may be easily disengaged to replace the doctor blades. The reservoir chamber of the assembly has a longitudinal internal groove which is employed to direct liquid within the reservoir to evenly wet the surface of the rapidly rotating transfer roll. The assembly further includes a liquid inlet line and vertically adjustable liquid outlet lines which are positioned to provide an optimum level of wetting liquid within the reservoir and a constant flow of liquid within the reservoir.

29 Claims, 13 Drawing Figures

FIG. 5
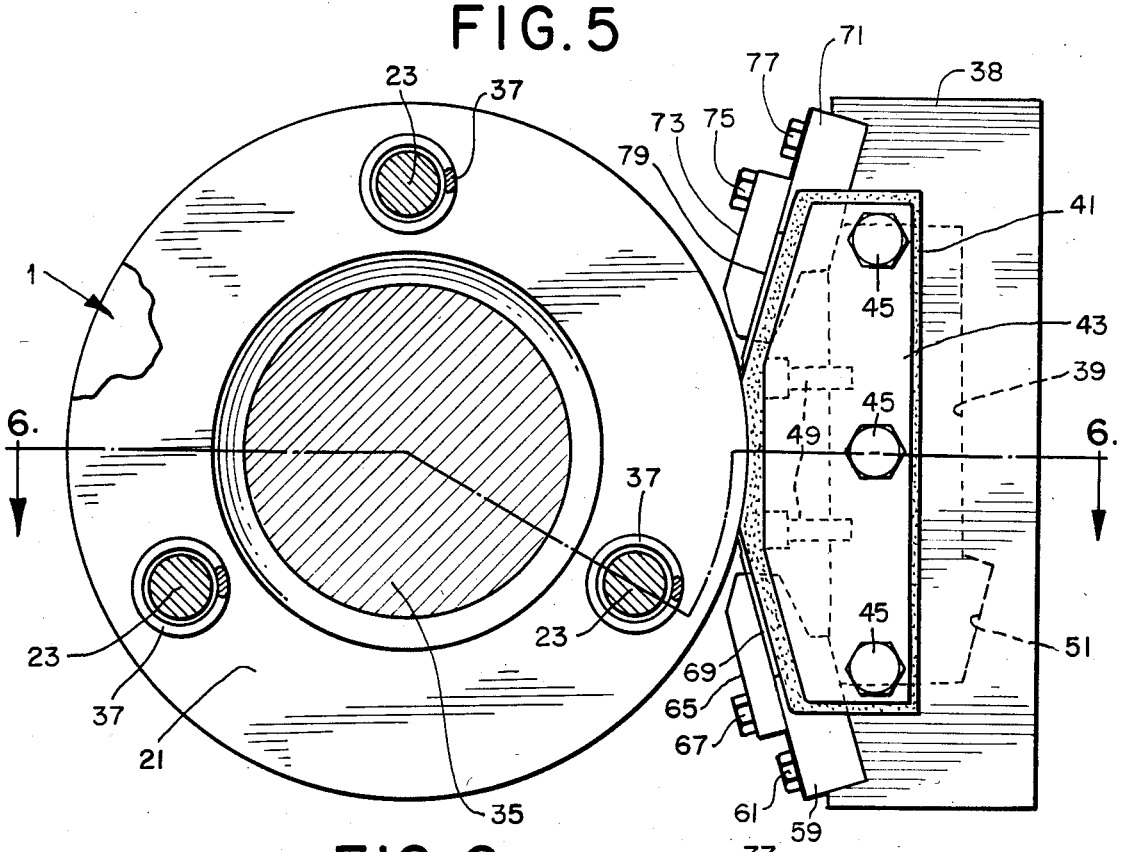
FIG. 6a
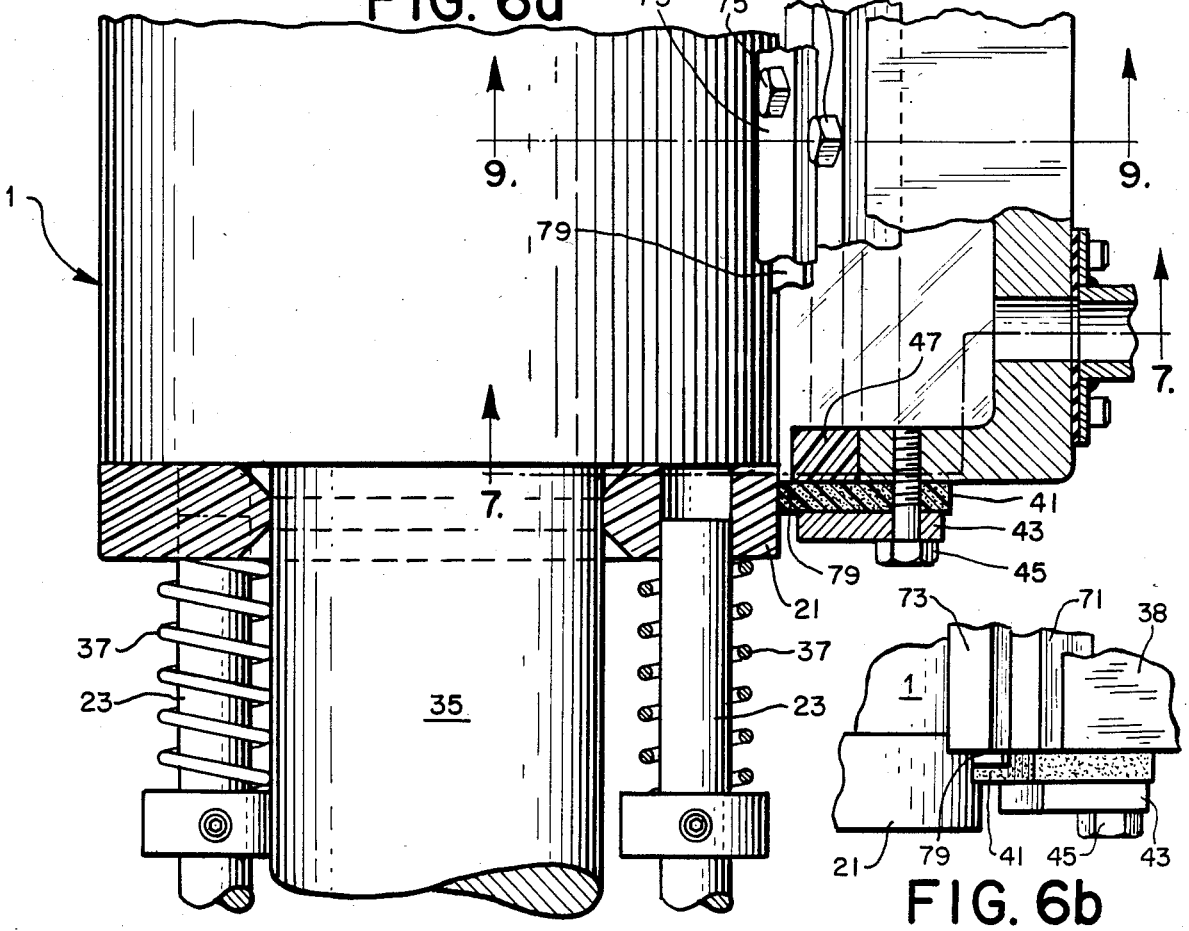
FIG. 6b

FIG. 11
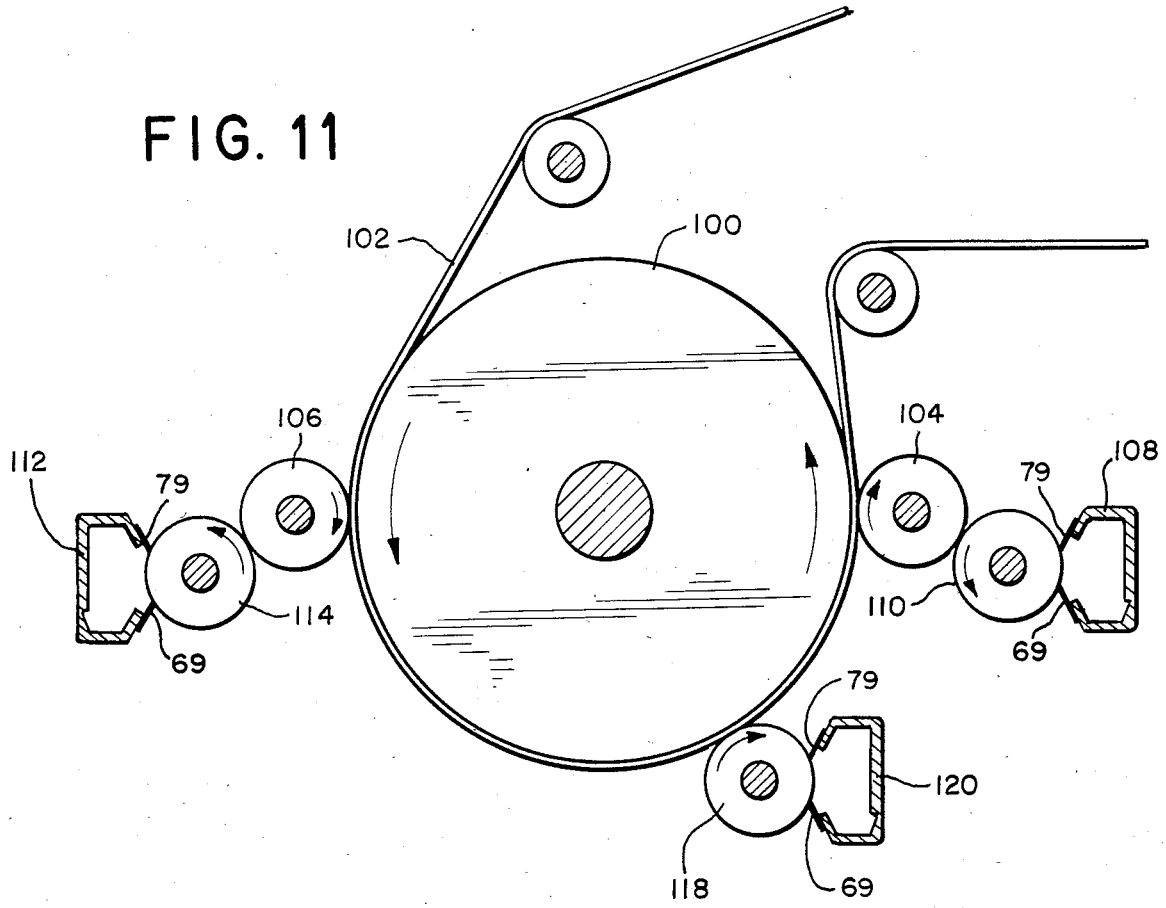
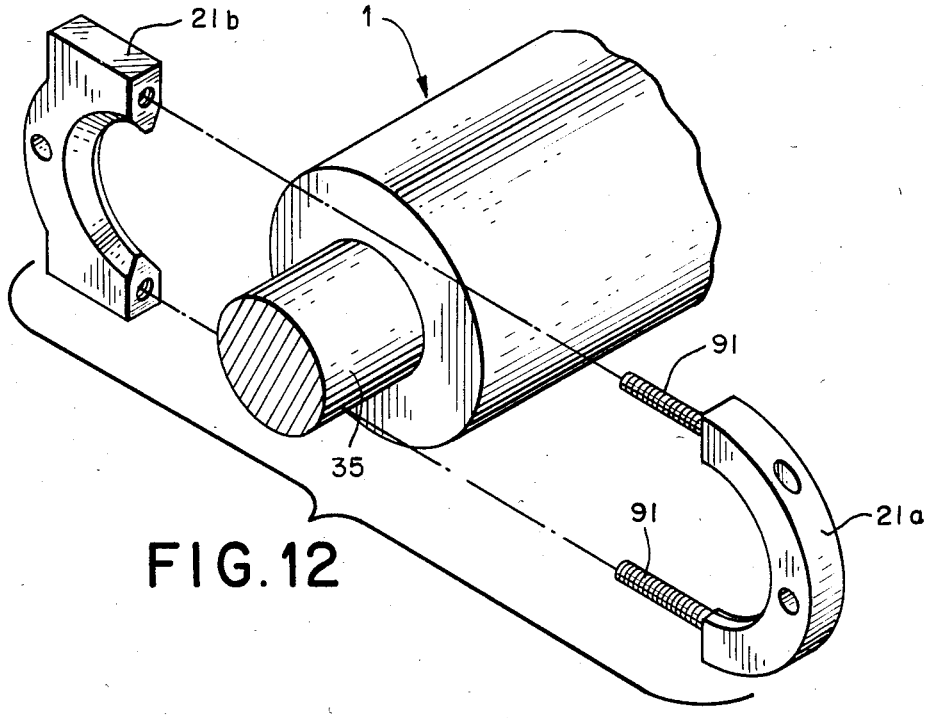
FIG. 12

REVERSE ANGLE DOCTOR BLADE ASSEMBLY WITH STATIONARY END SEAL

TECHNICAL FIELD

The invention relates to an apparatus wherein a rotation transfer or anilox roll applies a liquid such as ink or an adhesive to a rotating plate roll which transfers the liquid to the surface of a web of material. Alternatively, the invention relates to an apparatus wherein an engraved printing cylinder directly transfers liquid to a web of material. More particularly, the invention is directed to such apparatus wherein a reverse angle doctor blade assembly meters liquid onto the anilox roll or printing cylinder from a reservoir which communicates with the roll or cylinder and which is sealed against the roll or cylinder by stationary sealing elements.

BACKGROUND OF THE INVENTION

In modern flexographic liquid application systems, a transfer roll such as an anilox roll is wetted by a liquid, for example ink or an adhesive, and is rotated to apply the liquid to the surface of an adjacent rotating plate roll. The plate roll has a a rubber surface which is shaped or engraved to pick up liquid from the transfer roll and to deposit the liquid in a desired pattern on the surface of an adjacent moving web of material.

In a gravure system, the transfer roll is an engraved printing cylinder which transfers liquid in a desired pattern directly onto the surface of a web of material. In such known systems, the transfer roll picks up the wetting liquid from a trough or "fountain" and rotates to meter a desired amount of liquid onto the adjacent plate roll or web of material.

Rapidly rotating transfer rolls in known apparatus typically fling excess liquid radially and axially of the transfer roll during the liquid application process. It is known to utilize fluid deflectors or "slingers" at the ends of the transfer roll to direct at least a portion of the liquid flung from the roll back into the underlying trough or fountain. A substantial amount of liquid is lost in this process and liquid is also easily splashed or sprayed over the driving mechanism of the transfer roll or even over the web. Also, the liquid in the trough may thicken as a result of evaporation or contamination.

Moreover, as the rotational speed of the transfer roll increases to, for example, 800 feet per minute, the roll may be unevenly wetted. In operation, this results in a "starvation" phenomenon wherein ink or other liquid is unevenly transferred to the web and printing or coating is therefore incomplete.

In the U.S. Pat. No. 2,931,297 to E. A. Coudriet, entitled Ink Seal Means For Rotary Intaglio Printing Mechanism, a printing apparatus is disclosed which allows relatively high speed wetting of a web, for example at about 1,000 feet per minute. This relatively high speed operation is attained by utilizing a doctor blade assembly in association with a reservoir chamber through which wetting liquid is pumped. The reservoir chamber is sealed at its ends to block the axial slinging of liquid and to thus allow relatively even wetting of the transfer roll at relatively high rotational speeds. This system has the added advantage of maintaining a relatively constant flow of liquid within the reservoir, thus avoiding problems associated in the prior art with contamination of wetting liquid and drying and thickening of stagnant liquid in a fountain.

An end sealed reservoir can also provide a relatively even wetting of a transfer roll, even if the viscosity of the wetting liquid changes. In prior systems changes in viscosity of the wetting liquid would cause corresponding undesirable changes in the uniformity of wetting of the transfer roll.

The reservoir end seals of the Coudriet patent are formed by relatively resilient sealing elements which are pressed against the rotating surface of a transfer roll to seal the reservoir against the roll. In operation, these resilient seals rub against the moving surface of the roll and must therefore be changed frequently in order to maintain a fluid seal. Replacing worn end seals requires a substantial amount of time and therefore reduces the speed advantage obtained by providing an end sealed reservoir. Also, the end sealed apparatus must operate with a special transfer roll which has relatively smooth sealing areas at its ends. The end sealed reservoir structure therefore provides some advantages over prior structures but also has the disadvantage of requiring a special transfer roll and relatively frequent changes of its sealing components.

It has been suggested that an advantageous liquid transfer operation may be achieved in an apparatus utilizing a single doctor blade by resting opposite ends of the doctor blade upon stationary rings that are mounted in spaced relation to the ends of a rotating transfer roll. In operation, liquid accumulated between the ends of the roll and the adjacent rings is retained by capillary attraction and is therefore not flung from the roll. This apparatus has the disadvantage of utilizing a trough or fountain, with the associated problems of liquid contamination and stagnant liquid in the fountain. Moreover, the apparatus has the above-described fluid starvation problems and is therefore not suitable for relatively high speed operation.

Accordingly, it is an object of the invention to provide a high speed liquid transfer apparatus which employs a reverse doctor blade assembly with a liquid reservoir having stationary end seals which seal the reservoir in fluid communication with the rotating surface of a transfer roll.

A further object of the invention is to provide such stationary end seals with resilient sealing elements which sealingly engage seal support elements mounted in stationary sliding relation to the ends of the transfer roll.

In liquid transfer systems which employ a sealed reservoir to apply liquid to a rotating transfer roll it is important to maintain a constant, relatively even level of wetting liquid within the reservoir and a constant flow of liquid through the reservoir. A constant flow is required to avoid settling of constituents of the liquid, particularly when water base inks are used. A constant supply of fresh liquid at a modest flow rate is also useful in eliminating or reducing foaming of the liquid within the reservoir and in minimizing the volume of liquid required to supply the reservoir.

Accordingly, it is a further object of the invention to provide a liquid transfer apparatus with a doctor blade assembly which includes a closed reservoir with a central supply inlet and vertically adjustable end outlets for removing liquid from the reservoir to maintain a constant level of liquid within the reservoir and a constant flow of liquid through the reservoir.

It is another object of the invention to provide an apparatus with a reduced volume of liquid flowing through the reservoir in order to minimize the total volume of liquid required for circulation and to thereby increase the efficiency and reduce the cost of operation of the apparatus.

It is important in manufacturing to increase efficiency by reducing the amount of time required to replace worn doctor blades.

Accordingly, it is another object of the invention to provide a doctor blade assembly which may be easily and quickly operated to change doctor blades.

The doctor blade assembly of the invention provides a relatively even wetting for webs travelling at 2000 or more feet per minute. It has been found that such high speed operation can cause an undesirable turbulent cascading of liquid within the reservoir when the doctor blade shears excess liquid from its transfer roll. The turbulent cascading of liquid within the reservoir causes an uneven wetting of the rapidly moving transfer roll and thus reduces the reliability of the system.

Accordingly, it is an object of the invention to provide an end sealed reservoir of a reverse doctor blade assembly with a shape which reduces and controls turbulent flow of wetting liquid within the reservoir.

It is a further object of the invention to provide a longitudinal groove within the reservoir to direct fluid sheared by the doctor blade in an arc to the surface of the moving transfer roll and thus reduce and control turbulent flow or cascading of wetting liquid within the reservoir.

SUMMARY OF THE INVENTION

In order to achieve the objects of the invention and to overcome the problems of the prior art, the liquid transfer apparatus of the invention includes a transfer roll with stationary end seal support rings held in stationary sliding relation to the ends of the roll by spring biased pins. A reverse angle doctor blade assembly is positioned adjacent to the transfer roll to uniformly meter a wetting liquid to the moving surface of the roll.

The doctor blade assembly includes a reservoir which is held in liquid communication with the surface of the transfer roll. End seals of the reservoir sealingly engage the stationary end seal supports to provide a liquid seal between the reservoir and the transfer roll.

The assembly includes two opposed doctor blades which are mounted against the surface of the transfer roll. Each doctor blade is supported between a base bracket and a holding bracket. The holding bracket is screwed to the base bracket in order to hold the doctor blade in position. One of the doctor blades acts to shear excess liquid from the moving surface of the transfer roll and the other blade operates to trap liquid within the reservoir.

The reservoir of the doctor blade assembly has a longitudinal groove formed in its internal back wall to direct sheared liquid from a doctor blade to the surface of the moving transfer roll, in order to evenly wet the transfer roll.

The reservoir includes an inlet for supplying wetting liquid to the interior of the reservoir and at least two vertically adjustable outlets for draining the reservoir to provide a desired level of wetting liquid within the reservoir and a constant flow of liquid through the reservoir.

BRIEF DESCRIPTION OF THE DRAWINGS

FIG. 5 illustrates an end view of the doctor blade assembly in association with a partial sectional view of the transfer roll of FIG. 1, taken along a line 5—5.

FIG. *6a* illustrates a sectional view of an end of the transfer roll and doctor blade assembly of FIG. 5, taken along a line 6—6.

FIG. *6b* illustrates a partial plan view of the seal portion of an end of the transfer roll and doctor blade assembly of FIG. 5.

Figure 7:
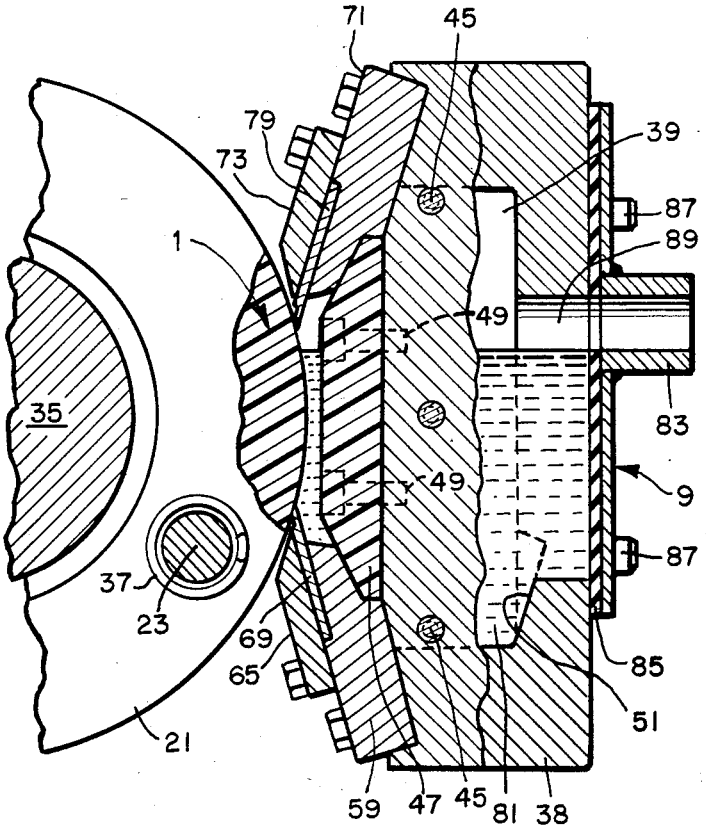

FIG. 7 illustrates an end sectional view of the transfer roll and of the doctor blade assembly of FIG. *6a*, taken along a line 7—7.

Figure 1:
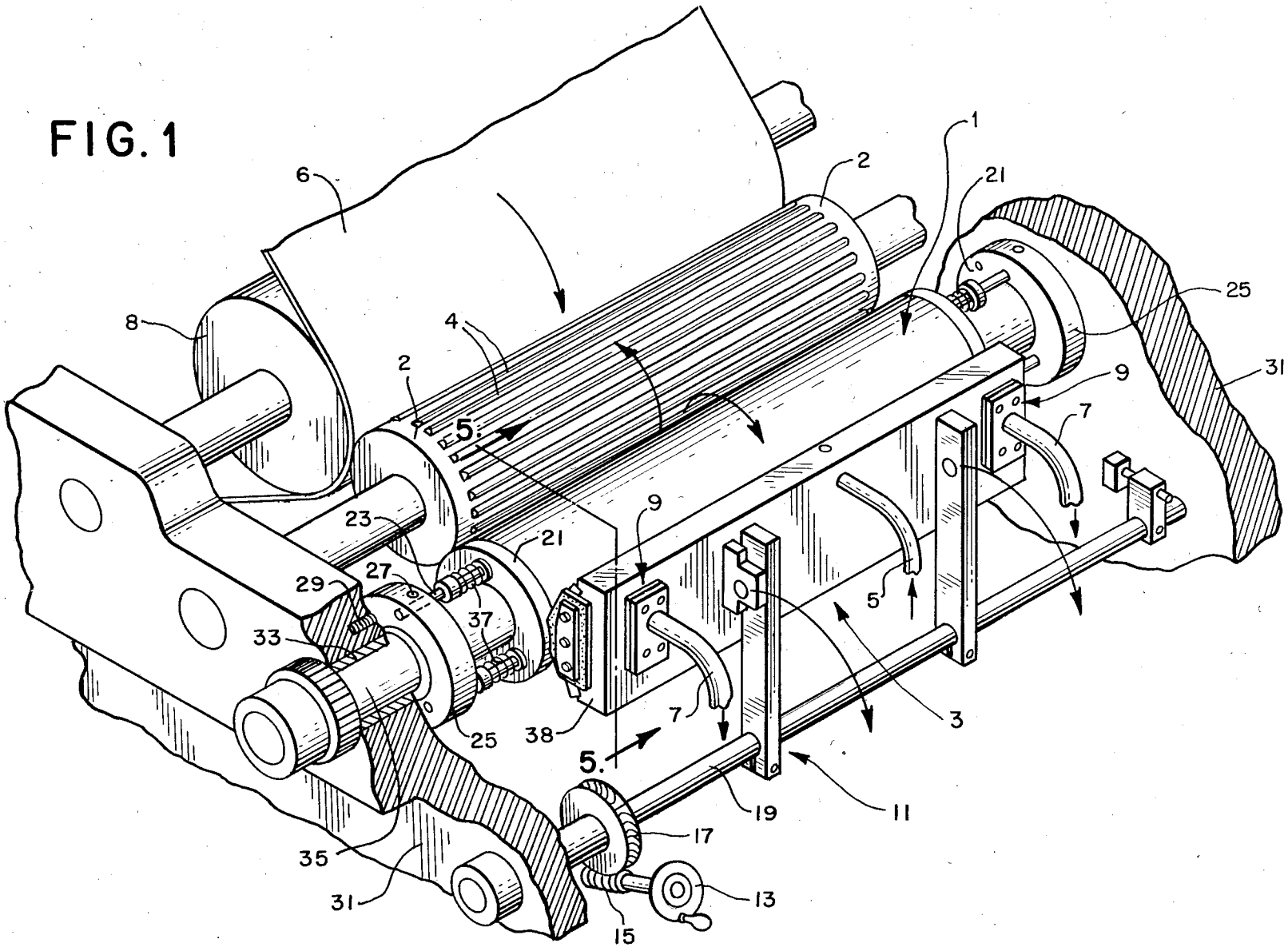
FIG. 1 illustrates a perspective view in partial section of a transfer roll and an associated doctor blade assembly of the invention.
Figure 8:
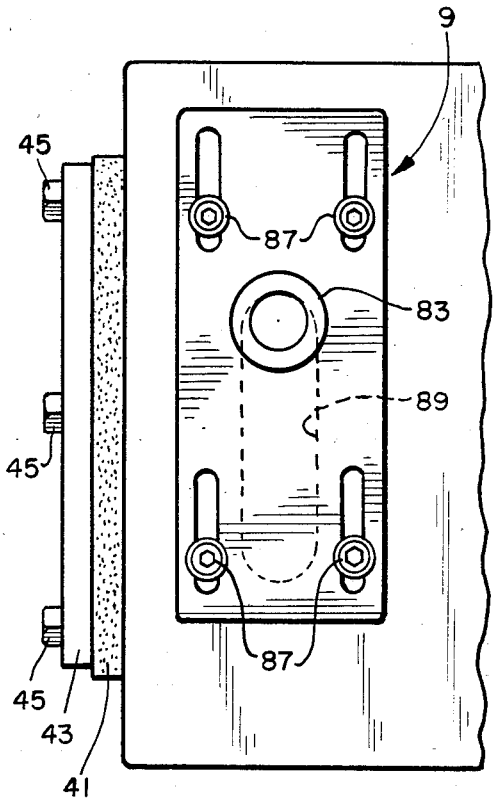

FIG. 8 illustrates a rear elevation view of one adjustable outlet assembly for the reservoir chamber of the doctor blade assembly of FIG. 1.

Figure 9:
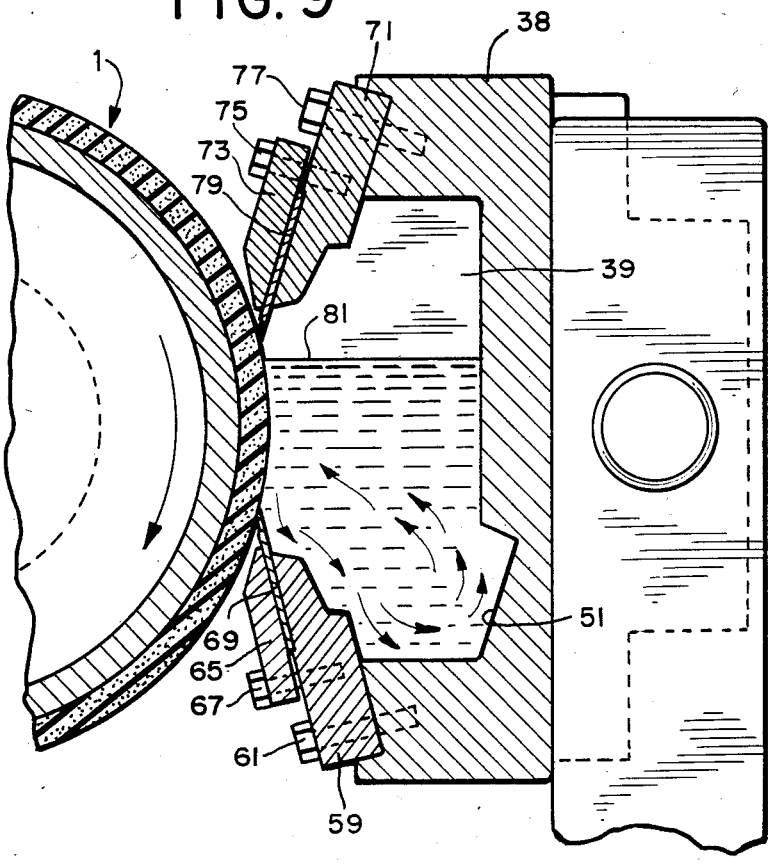

FIG. 9 illustrates a side elevation sectional view of the transfer roll and doctor blade assembly of FIG. *6a*, taken along a line 9—9.

Figure 10:
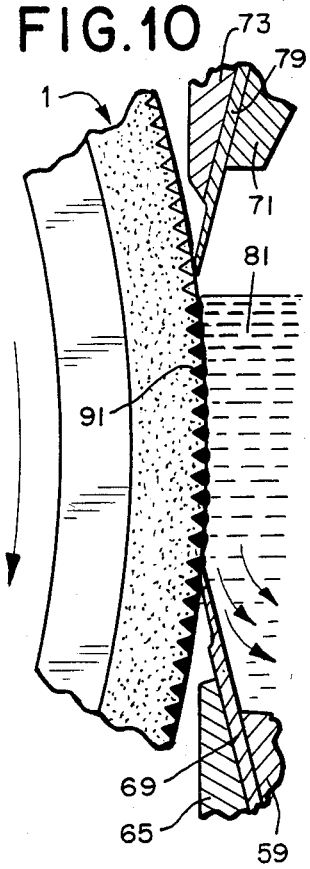

FIG. 10 illustrates an enlarged sectional view of a portion of the surface of the transfer roll and of the associated blades of the doctor blade assembly.

FIG. 11 is a diagrammic illustration of a system employing a plurality of doctor blade assemblies in accordance with the invention.

FIG. 12 illustrates an alternative embodiment of a stationary end seal support ring in accordance with the invention.

DETAILED DESCRIPTION OF PREFERRED EMBODIMENTS

The remaining portion of the specification will describe preferred embodiments of the invention when read in conjunction with the attached drawings, in which like reference characters identify identical apparatus.

FIG. 1 illustrates a perspective view in partial section of a flexographic fluid transfer assembly of the invention. As shown in FIG. 1, a transfer roll 1 such as an anilox roll is rotated, for example in the direction indicated by the arrow, to apply a liquid, for example ink or an adhesive, to the surface of an adjacent plate roll 2. The surface of the plate roll 2 may have raised rubber plates 4 which pick up liquid from the anilox roll and transfer the liquid in a desired pattern to a web of material 6 which is pressed against the plate roll 2 by an impression roller 8. The surface of the plate roll 2 could alternatively be covered by a rubber sheet with an engraved pattern. The plate roll would then apply liquid to the web in the pattern.

In the following discussion the apparatus of an embodiment of the invention is described with respect to an anilox transfer roll, such as is used in a flexographic system. However, it should be understood that the transfer roll could also be an engraved cylinder such as is used in a gravure system, without departing from the invention. Accordingly, it should be understood that the term "transfer roll" as used hereafter can encompass either the engraved cylinder of a gravure system or the anilox roll of a flexographic system.

In operation of the system of FIG. 1, a wetting liquid is pumped through an inlet line 5 to a reservoir cavity within a reverse angle doctor blade assembly 3. The rotating surface of the transfer roll 1 defines one wall of the reservoir cavity and is thus wetted by the liquid within the reservoir. As is known to those skilled in the art, wetting is achieved by filling microscopic pores which are formed in the surface of the roll. Excess liquid is removed by outlet lines 7 which are vertically adjusted by outlet assemblies 9 to define a particular desired level of wetting liquid and to maintain a constant flow of liquid within the reservoir. The spaced outlet lines 7 provide a "flow through" operation which minimizes splashing of liquid within the reservoir and avoids contamination and separation of the constituents of the liquid.

The illustrated system may utilize a relatively low power pump (not shown) which provides a relatively low volume flow of, for example, 0.5 to 0.75 gallons per minute. The relatively low volume flow minimizes the total volume of liquid required for circulation and therefore increases the efficiency and reduces the cost of operation of the system.

The doctor blade assembly 3 is affixed to a mounting assembly 11 which is pivotally moved by turning a crank 13 to rotate a worm gear 15 and an associated engaged gear 17. The gear 17 rotates a support shaft 19 and thus selectively pivots the doctor blade assembly into and out of engagement with the transfer roll 1.

End seal support rings 21 are disposed in slidable relation to the ends of the transfer roll 1. The support rings 21 are preferably made of a graphite impregnated nylon material. However, other materials with a low coefficient of friction could be used, for example, a Teflon impregnated nylon material or a silicon impregnated nylon material.

Each of the support rings 21 is held in stationary relation to the transfer roll 1 by pins 23 which are affixed within holes of an adjacent support collar 25 by screws 27. Springs 37 of the pins press the rings 21 against their respective ends of the transfer roll. Alternatively, wave washers could be employed to press the rings against the ends of the transfer roll.

Each support collar 25 is mounted, for example by screws 29, to a support wall 31 of the assembly. Each support wall 31 has a bearing 33 which supports an end of a shaft 35 of the transfer roll 1 for rotation.

The support rings 21 are thus held in stationary relation to the rotating transfer roll 1 by the pins 23. The springs 37 press the rings 21 against the ends of the transfer roll 1 and thus ensure an even sliding contact between the inside face of the rings 21 and the ends of the roll 1.

Figure 2:
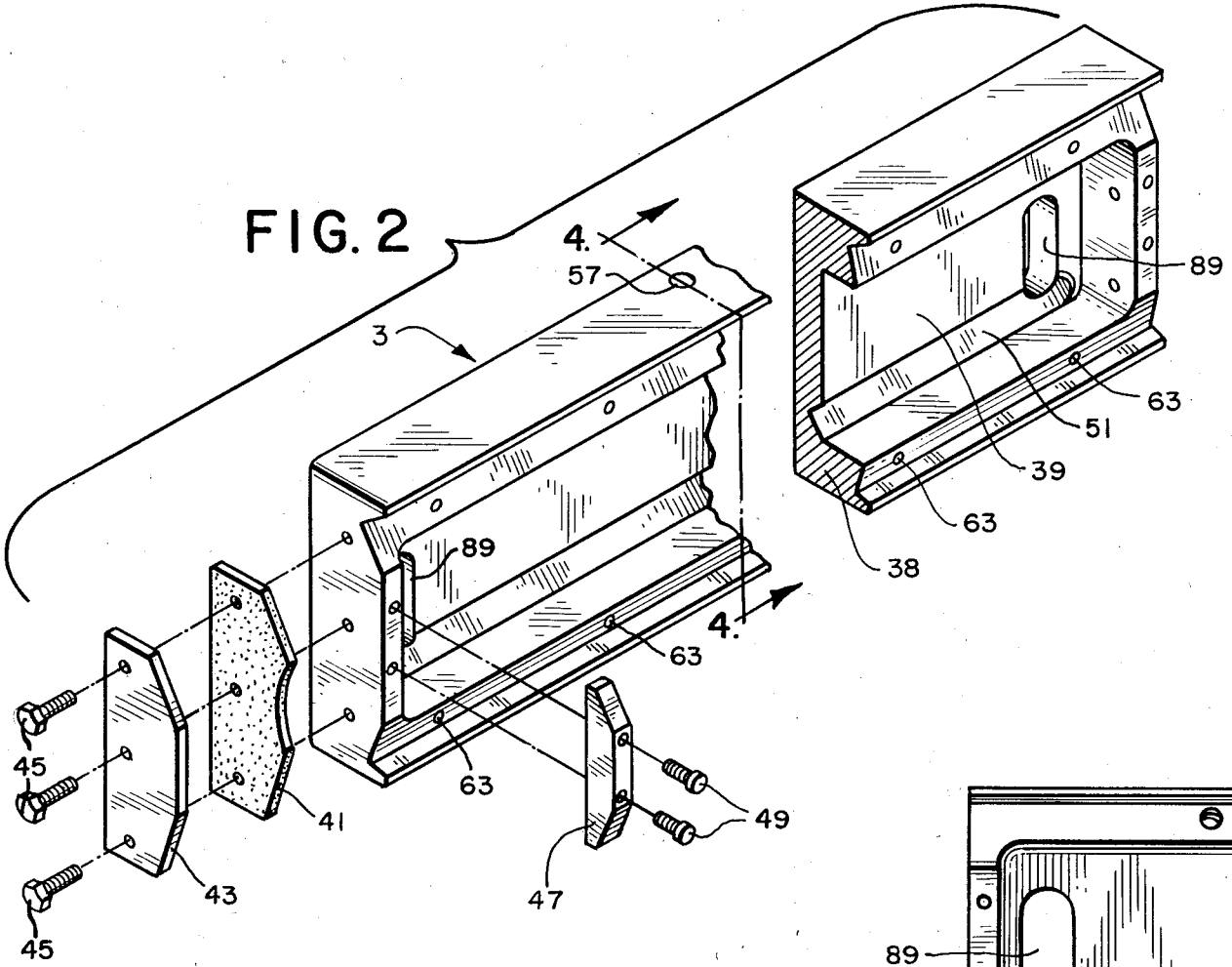
FIG. 2 illustrates an exploded view of a reservoir chamber of the doctor blade assembly of the invention.

FIG. 2 illustrates an exploded view of a reservoir chamber 38 of the doctor blade assembly 3. As shown in FIG. 2, a resilient end seal 41 made of, for example neoprene, and an associated metal end plate 43 are affixed to the ends of the reservoir chamber by screws 45. A relatively rigid support plate 47 is affixed to the reservoir by screws 49 to provide lateral support for the seal 41. For simplicity of illustration, the end seal, end plate, and support plate are shown on only one end of the reservoir. It should be understood that similar elements are provided at the opposite end of the reservoir.

Figure 3:
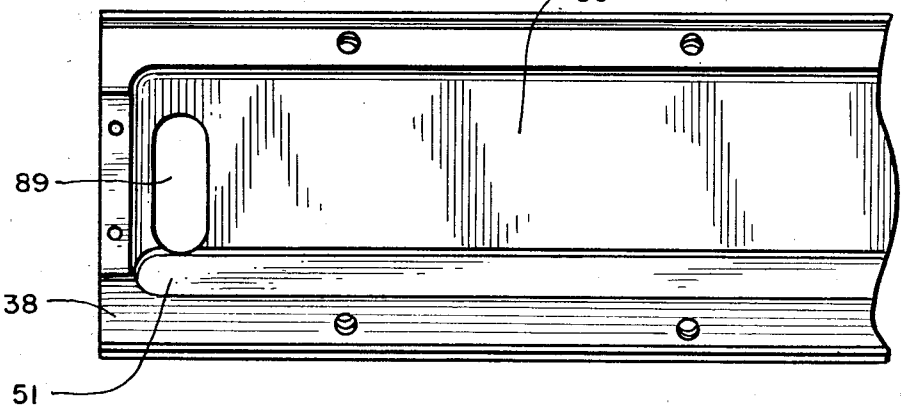
FIG. 3 illustrates an elevation view of a portion of the back inside wall of the reservoir chamber of FIG. 2.

FIG. 3 illustrates a partial cut-away view of a portion of the internal surface of the reservoir cavity 39. As shown in FIG. 3, a groove 51 is formed along the length of the back wall of the reservoir to control the movement of liquid within the reservoir. An outlet slot 89 is provided at opposite ends of the reservoir to provide fluid communication between the cavity 39 and the outlet lines 7.

Figure 4:
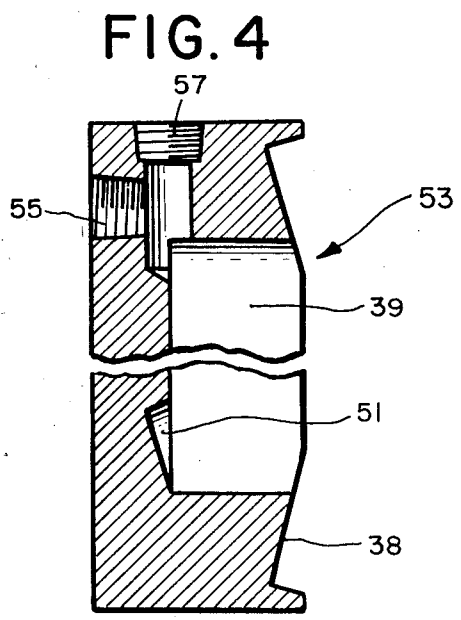
FIG. 4 illustrates an expanded cross-sectional view of a fluid inlet portion of the reservoir chamber of FIG. 2.

FIG. 4 illustrates an expanded cross-sectional view of a fluid inlet portion 53 of the reservoir chamber 38. As shown in FIG. 4, a hole 55 is drilled through the back wall of the reservoir chamber 38 and a corresponding intersecting hole 57 is drilled through the top surface of the reservoir. The hole 55 may be threaded to sealingly engage the fluid inlet line 5 which supplies wetting liquid to the reservoir. The hole 57 may be threaded to receive a sealing plug (not shown) so that fluid will pass through the inlet line 5 and into the reservoir cavity 39.

FIG. 5 illustrates a sectional view of the doctor blade assembly 3 and the transfer roll 1 of FIG. 1, taken along a line 5—5. As shown in FIG. 5, a doctor blade holder 59 extends longitudinally in parallel relation to the transfer roll 1 and is affixed to the reservoir chamber 38 by screws 61 which engage threaded holes 63 tapped in the reservoir chamber. A doctor blade clamp 65 is detachably affixed to the underlying holder 59 by screws 67 which engage threaded holes in the holder 59. A doctor blade 69 is supported within a mating slot formed in the holder 59 and is held in position within the slot by the pressure of the opposing clamp 65. The doctor blade 69 is supported by the holder 59 and clamp 65 in contact with the surface of the transfer roll 1 in order to prevent liquid from leaking from the bottom of the reservoir.

An opposite support assembly including a doctor blade holder 71, a doctor blade clamp 73 and associated screws 75 and 77 are provided to support a doctor blade 79 in the same manner as is described for the blade 69. As shown in FIG. 5, each of the doctor blades 69 and 79 is disposed in opposing relation to the surface of the transfer roll 1, preferably at an angle of 30° of tangent to the roll. In operation, as the transfer roll 1 rotates, liquid within the reservoir cavity 39 wets the microporous surface of the transfer roll and one of the doctor blades shears off excess liquid to provide an evenly wetted surface as the transfer roll rotates out of the reservoir cavity of the assembly.

FIG. 6*a* illustrates a top sectional view of the transfer roll and doctor blade assembly of FIG. 5, taken along a line 6—6. FIG. 6*b* illustrates a partial plan view of an end of the transfer roll and doctor blade assembly of FIG. 5. As shown in these figures, a fluid seal is provided at each end of the reservoir assembly 38 by pressing the resilient end seal 41 against the stationary opposite surface of its support ring 21. The support plate 47 laterally supports the flexible end seal 41 in its upright sealing position. As previously explained, the ring 21 is held in stationary relation with respect to the rotating transfer roll 1 by support pins 23 which are engaged in holes tapped in the ring 21. Thus, in operation, the transfer roll 1 freely rotates to receive liquid applied by the doctor blade assembly and the stationary support rings 21 and seals 41 provide a reliable liquid seal at the ends of the transfer roll. The sealed reservoir prevents dust or other debris in the atmosphere surrounding the reservoir assembly from contaminating the liquid flowing through the rservoir. Moreover, the end seals have a relatively long life, because there is not relative movement between the stationary support rings 21 and their associated resilient sealing elements 41.

FIG. 7 illustrates a sectional view of the transfer roll and doctor blade assembly 3 of FIG. 6*a* taken along a line 7—7. As shown in FIG. 7 and in the partial side elevation view of FIG. 8, wetting liquid 81 is held in the reservoir cavity 39 at a level which is determined by the vertical orientation of each of two outlet assemblies 9, only one of which is illustrated. The outlet assembly 9 includes an outlet flange 83 which is held in sealing contact with the back wall of the reservoir chamber 38 by a resilient outlet seal 85. Screws 87 are provided to adjust the vertical position of the outlet opening of the flange 83 in relation to the outlet slot 89 formed through the back wall of the reservoir chamber. The vertical orientation of the outlet may thus be adjusted to provide a particular desired level of wetting liquid within the reservoir.

FIG. 9 illustrates a sectional view of the transfer roll and doctor blade assembly of FIG. 6*a*, taken along a line 9—9. FIG. 9 illustrates the manner in which liquid 81 within the reservoir wets the adjacent surface of the transfer roll 1, when the roll is rotated clockwise in the direction of the arrow. With reference to FIG. 10, as the surface of the transfer roll moves within the reservoir cavity 39, micropores 91 retain the wetting liquid 81. As the wetted surface of the transfer roll 1 approaches the doctor blade 69, the blade shears excess liquid at the surface of the roll and thus causes the liquid to be sprayed away from the roll, as shown by the arrows of FIGS. 9 and 10. It has been found that the upper doctor blade 79 may either contact the roll 1 or be slightly spaced from the roll 1 without affecting the metering operation of the doctor blade 69.

With reference to FIG. 9, the liquid sheared by the blade 69 is directed to the longitudinal groove 51 within the reservoir cavity 39. The liquid is deflected by the groove 51 and is uniformly directed against the surface of the roll 1. The groove 51 operates to reduce and control turbulence within the reservoir cavity 39 and thus provides for a relatively even wetting of the surface of the transfer roll. It should also be appreciated that the shearing of liquid from the roll and the resultant spraying of liquid occurs within the closed reservoir assembly and therefore avoids prior art problems associated with spraying liquid in an exposed area.

Turbulence within the reservoir has been satisfactorily controlled by a groove 51 which is approximately one-quarter inch deep and one-third of the height of the reservoir cavity 39. It is theorized that the upper lip of the groove deflects the cascade of liquid within the cavity and thus prevents the liquid from flowing up the back wall of the reservoir and interfering with uniform metering. If this is the case, it is possible that a raised ridge could be employed on the back wall of the reservoir in place of the groove to deflect the cascade of liquid and thus provide the desirable liquid control function of the invention. It is further theorized that satisfactory results could be achieved by grooves with different dimensions relative to the dimensions of the reservoir.

The reverse angle doctor blade assembly of the apparatus of the invention evenly and cleanly wets the surface of a rapidly rotating transfer roll, because the end seals of the reservoir prevent leakage or spraying of liquid from the ends of the reservoir and thus hold the liquid in a relatively stationary, stable position with respect to the roll. The stable relationship of the liquid in relation to the roll enables the transfer roll to be rotated more rapidly than has heretofore been possible with known liquid transfer apparatus. Also, the even wetting makes the apparatus of the invention less sensitive to changes in viscosity of wetting liquid and thus provides for an improved and rapid wetting of the surface of a transfer roll over a relatively wide range of liquid viscosity. The groove 51 at the back wall of the reservoir cavity further ensures a stable and even application of liquid, even at high rates of rotation of the roll.

The mounting brackets for the blades 69 and 79 are provided to allow easy removal and replacement of the blades. Thus, if either or both of the blades needs to be changed, it is not necessary to remove the entire reservoir assembly. In operation, either doctor blade may be removed by disengaging the reservoir assembly from its transfer roll and loosening the screws which retain the clamp (65,73) against its underlying holder (59,71). When the screws are loosened, the doctor blade is readily removed and a new blade is inserted. The retaining screws are then tightened to hold the new doctor blade in place.

As explained above, the stationary end seals provide a reliable liquid seal at the ends of the reservoir chamber. The high speed movement of the transfer roll does not deteriorate the end seal, because each seal is mounted in stationary relation to its associated support ring which slidingly engages an end of the transfer roll. Each ring is resiliently pressed against its end of the transfer roll to maintain an even sliding contact between the roll and ring. The support rings may thus be used with a wide range of commercially available transfer rolls.

The reverse angle doctor blade assembly of the invention is "non-handed". That is, the assembly will meter liquid onto the transfer roll 1 without regard to the direction of rotation of the roll. As explained previously with reference to FIG. 9, the lower doctor blade 69 will meter liquid when the roll is rotated clockwise. If the transfer roll 1 rotates counter-clockwise, the micropores 91 will pick up liquid within the reservoir as previously discussed and the upper doctor blade 79 will meter the liquid by shearing excess liquid from the surface of the roll. In this operation the doctor blade 79 contacts the surface of the roll to meter liquid onto the roll. The lower doctor blade 69 in this operation acts merely to trap liquid within the reservoir.

It has been found that the doctor blade 79 does not require an adjacent fluid deflection groove to meter liquid onto the roll. Accordingly, the groove 51 is only required at the bottom of the reservoir, as shown in FIG. 9.

The non-handed operation of the apparatus of the invention is shown in the diagrammic illustration of FIG. 11. As shown in FIG. 11, an impression roller 100 rotates counterclockwise and presses a web of material 102 against plate rolls 104 and 106 and an etched cylinder 108.

On the upside of the roll 100, the doctor blade 79 of a doctor blade assembly 108 meters liquid onto an anilox roll 110. The roll 110 applies the liquid to the plate roll 104 which in turn applies the liquid in a desired pattern on the web 102.

On the downside of the roll 100, the doctor blade 69 of another doctor blade assembly 112 meters liquid onto an anilox roll 114. The plate roll 106 then transfers the liquid in a desired pattern to the web 102.

An engraved or etched printing cylinder 118 also receives liquid metered by the doctor blade 69 of a doctor blade assembly 120 and directly applies the liquid to the web 102.

As shown in FIG. 11, the versatile doctor blade assembly of the invention meters liquid onto a transfer roll without regard to the direction of rotation of the roll. Doctor blade assemblies may therefore be easily and quickly positioned to operate in any desired system configuration, without requiring expensive and time consuming hardware changes.

Although support rings 21 have been disclosed in the illustrated doctor blade assembly, a stationary seal support element having any desirable shape may be employed without departing from the spirit of the invention. It is only necessary that the stationary support element have a relatively smooth contact surface for pressing against the resilient seals 41 at the ends of the reservoir chamber.

FIG. 12 illustrates an alternative embodiment of a stationary support ring which may be used to provide the end seal for the apparatus of FIG. 1. With reference to FIG. 12, the stationary support portion of the end seal is formed by a two piece C-ring having opposing elements 21*a* and 21*b* which are detachably connected by screws 91. The C-ring elements 21*a* and 21*b* are provided to allow relatively easy and rapid changing of the seal support surface for the stationary end seals 41 of the reservoir chamber. As explained above, other structures for stationary end seal supports may be provided without departing from the invention.

Although the doctor blade assembly 3 is preferably held in a fixed position with respect to the transfer roll, it may be oscillated from side to side in a manner known in the art to dispense liquid onto the roll. Also, although apparatus of the invention has been described primarily with respect to a liquid transfer roll such as an anilox roll, it should be understood that other types of rolls such as engraved printing rolls may be employed without departing from the invention.

The invention may be embodied in other specific forms than those illustrated, without departing from its spirit or essential characteristics. The present embodiments are, therefore, to be considered in all respects as illustrative and not restrictive. The scope of the invention is indicated by the claims rather than by the foregoing description and, accordingly, all changes which come within the meaning and range of the equivalents of the claims are intended to be embraced therein.

We claim:

1. A liquid transfer apparatus, comprising:

reservoir means having ends and intermediate walls defining a reservoir cavity for holding liquid;

transfer roll means having ends mounted for rotation about an axis and having a transfer surface intermediate said ends for rotating to retain a metered quantity of said liquid;

means for engaging said transfer roll means within said reservoir cavity and rotating said transfer roll means about said axis so that said transfer surface retains liquid from said reservoir cavity;

end seal support means mounted in stationary, slidable relation to the ends of said transfer roll means and having a sealing surface portion coplanar with an adjacent abutting portion of said transfer surface;;

end seal means for sealing the ends of said reservoir means and having a sealing edge conforming to said sealing surface portion of said end seal support means for engaging said sealing surface portion to provide a stationary seal at the ends of said transfer roll means;

at least one doctor blade means having an edge for removing excess liquid adhering to said transfer surface as said transfer roll means rotates; and means for supporting said doctor blade means adjacent to and extending along the length of the transfer roll means with the ends of the doctor blade means in sealing engagement with at least a portion of said end seal means and said edge of the doctor blade means extending over said transfer surface.

2. The liquid transfer apparatus of claim 1, including at least one inlet means for supplying liquid to said reservoir means and at least one outlet means for removing liquid from said reservoir means to maintain a constant flow of liquid through said reservoir means.

3. The liquid transfer apparatus of claim 2, including an outlet means disposed at opposite ends of said reservoir means, said inlet means located between the outlet means.

4. The liquid transfer apparatus of claim 1, including inlet means for supplying liquid to said reservoir means, outlet means for removing liquid from the reservoir means, and means for selectively adjusting the vertical position of said outlet means with respect to said reservoir means to provide a desired level of liquid within said reservoir means.

5. The liquid transfer apparatus of claim 4, wherein said reservoir means includes means for deflecting said excess liquid sheared from said transfer roll means for maintaining the level of liquid within said reservoir means to evenly wet said transfer roll means.

6. The liquid transfer apparatus of claim 5, wherein said means for deflecting is a groove formed in said reservoir means.

7. The liquid transfer apparatus of claim 1, wherein said means for supporting includes means for supporting said at least one doctor blade means with said edge opposite the direction of rotation of said transfer roll means to shear excess liquid from said transfer surface.

8. The liquid transfer apparatus of claim 7, including a trapping blade spaced from said doctor blade means and adjacent said transfer surface for retaining liquid within said reservoir.

9. The liquid transfer apparatus of claim 8, wherein said shearing blade and trapping blade are oriented at approximately 30° of the tangent of said transfer roll means.

10. The liquid transfer apparatus of claim 8, including a first holder means for releasably supporting said doctor blade means and a second holder means for releasably supporting said trapping blade means, each holder means including a base holder for supporting a blade means, means for detachably affixing said base holder to said reservoir means, and a clamping means for detachably engaging said base holder and pressing the blade means against the base holder to hold the blade means in position.

11. The liquid transfer apparatus of claim 1, wherein said transfer roll means includes an anilox roll.

12. The liquid transfer apparatus of claim 1, wherein said transfer roll means includes an engraved printing cylinder.

13. A liquid transfer apparatus of a type wherein liquid in a reservoir wets the surface of a rotating transfer roll which then applies liquid to a moving web or intermediate roll, the improvement comprising:

a reservoir chamber having one open face;

means for circulating a liquid through said reservoir chamber;

a transfer roll disposed for rotation adjacent to said open face for receiving liquid from said reservoir chamber;

at least one reverse angle doctor blade means having an edge oriented in a direction opposite the direction of rotation of said transfer roll for shearing excess liquid from the surface of the transfer roll;

a seal support disposed at each end of said transfer roll, each seal support having a sealing surface coplanar with an adjacent abutting portion of the surface of said transfer roll;

means for holding each seal support in stationary, sliding relation to its end of the transfer roll; and a resilient seal disposed at each end of the reservoir chamber, each seal having an edge for sealingly engaging said sealing surface of its adjacent seal support and an adjacent end of said blade means to provide a liquid seal at the ends of said transfer roll and said reservoir chamber.

14. The liquid transfer apparatus of claim 13, including two reverse angle doctor blade means, one of said reverse angle doctor blade means disposed adjacent a top portion of said reservoir chamber for shearing excess liquid from said transfer roll when the transfer roll rotates in one direction and the other of said reverse angle doctor blade means disposed adjacent a bottom portion of said reservoir chamber for shearing excess liquid from said transfer roll when the transfer roll rotates in a direction opposite said one direction.

15. The liquid transfer apparatus of claim 13, wherein said reservoir chamber includes means for deflecting a cascade of liquid sheared by said at least one reverse angle doctor blade means away from the back of said reservoir chamber to maintain a relatively constant level of liquid within the reservoir chamber.

16. The liquid transfer apparatus of claim 15, wherein said means for deflecting is a longitudinal groove formed in a back wall of said reservoir chamber and adjacent to the bottom of the chamber.

17. The liquid transfer apparatus of claim 13, including means for detachably affixing said reverse angle doctor blade means to said reservoir chamber.

18. The liquid transfer apparatus of claim 13 wherein each seal supports includes a ring means for slidingly engaging an end of said transfer roll, holding pins for engaging said ring means to hold the ring means in stationary relation to said transfer roll, and springs for pressing the ring means against the end of the transfer roll.

19. The liquid transfer apparatus of claim 18, wherein said ring means includes two C-shaped portions and means for detachably coupling said portions to form a ring.

20. The liquid transfer apparatus of claim 13, wherein said means for circulating includes an inlet for supplying liquid to said reservoir chamber and two vertically adjustable outlets for removing liquid from the reservoir chamber and adjusting the level of liquid within the chamber, said outlets positioned at opposite ends of the reservoir chamber and said inlet positioned between the outlets.

21. The liquid transfer apparatus of claim 13, wherein said transfer roll is an anilox roll.

22. The liquid transfer apparatus of claim 13, wherein said transfer roll is an engraved printing cylinder.

23. A high speed liquid transfer apparatus, comprising:

a transfer roll and means for rotating said transfer roll;

a reservoir chamber for retaining liquid, said reservoir chamber having means for engaging in fluid communication with the surface of the transfer roll;

reverse doctor blade means for metering liquid from said reservoir onto the surface of said transfer roll, said reverse doctor blade means having an edge extending along the length of said transfer roll and oriented opposite the direction of rotation of said transfer roll for shearing excess liquid from the surface of the transfer roll;

seal support means mounted in stationary relation to said transfer roll;

resilient seal means for engaging said seal support means and said reverse doctor blade means to provide a seal against said liquid at the ends of said reservoir chamber and transfer roll; and liquid deflecting means disposed in the liquid of said reservoir chamber for deflecting a cascade of sheared liquid from said reverse doctor blade means away from the back of said reservoir chamber to maintain the level of liquid within the reservoir chamber.

24. The liquid transfer apparatus of claim 23, wherein said liquid deflecting means is a groove disposed in a back wall of said reservoir chamber.

25. The liquid transfer apparatus of claim 23, wherein said seal support means includes a support ring disposed at each end of said transfer roll in stationary sliding relation to its end of the transfer roll, each support ring having a sealing surface coplanar with the adjacent abutting surface of said transfer roll, said resilient seal means including a resilient seal disposed at each end of said reservoir chamber, each seal having an edge conforming to said sealing surface of a support ring for sealingly engaging said sealing surface and said reverse doctor blade means to provide a liquid seal at the ends of said transfer roll and said reservoir chamber.

26. A liquid transfer apparatus, comprising:

a transfer roll and means for rotating said transfer roll;

a reservoir chamber for retaining liquid, said reservoir chamber having means for engaging in liquid communication with the surface of the transfer roll;

reverse doctor blade means oriented opposite the direction of rotation of said transfer roll for shearing excess liquid from the surface of said transfer roll;

sealing means for providing a liquid seal at the ends of said reservoir chamber and said transfer roll; and a groove formed in a back wall of said reservoir chamber for deflecting a cascade of sheared liquid from said reverse doctor blade means away from the back wall of said reservoir chamber to control the turbulence of liquid within the reservoir chamber and thereby maintain a relatively constant level of liquid within the reservoir chamber.

27. A liquid transfer apparatus, comprising:

a reservoir chamber for retaining a liquid;

a transfer roll disposed for rotation with at least a portion of its surface in liquid communication within the reservoir chamber to receive liquid from the reservoir chamber;

means for circulating said liquid through said reservoir chamber;

a first blade means for shearing excess liquid from the surface of said transfer roll when the transfer roll rotates in one direction and for retaining liquid in said reservoir chamber when the transfer roll rotates in an opposite direction;

a second blade means for shearing excess liquid from the surface of said transfer roll when the transfer roll rotates in said opposite direction and for retaining liquid in said reservoir chamber when the transfer roll rotates in said one direction;

two seal supports, the seal supports disposed at opposite ends of said transfer roll;

means for holding each seal support in stationary sliding relation to its end of the transfer roll;

a resilient seal disposed at each end of the reservoir chamber, each seal sealingly engaging an adjacent stationary seal support to provide a liquid seal at the ends of said transfer roll and said reservoir chamber; and deflector means disposed within said reservoir chamber for deflecting liquid sheared from at least one of said blade means away from a back wall of said reservoir chamber to control the turbulence of liquid within the reservoir chamber and thereby maintain a relatively constant level of liquid within the chamber.

28. The liquid transfer apparatus of claim 27, wherein said deflector means includes a groove formed in the back wall of said reservoir chamber.

29. The liquid transfer apparatus of claim 27, wherein said means for circulating includes an inlet for supplying liquid to said reservoir chamber and two vertically adjustable outlets for removing liquid from the reservoir chamber and adjusting the level of liquid within the chamber, said outlets positioned at opposite ends of the reservoir chamber and said inlet positioned between the outlets.

* * * * *

UNITED STATES PATENT AND TRADEMARK OFFICE

CERTIFICATE OF CORRECTION

PATENT NO. : 4,590,855

DATED : May 27, 1986

INVENTOR(S) : David L. Schommer and Wayne LaValliere

It is certified that error appears in the above-identified patent and that said Letters Patent is hereby corrected as shown below:

In claim 5, line 1, please delete "claim 4," and substitute therefor --claim 7,--;

In claim 18, line 2, after "each" insert --of said--.

Signed and Sealed this

Ninth Day of December, 1986

*Attest:*

DONALD J. QUIGG

*Attesting Officer* *Commissioner of Patents and Trademarks*